US005551102A

United States Patent [19]

Stewart et al.

[11] Patent Number: 5,551,102

[45] Date of Patent: Sep. 3, 1996

[54] MOBILE DECONTAMINATION AND CONTAINMENT UNIT

[76] Inventors: Craig Stewart, 577 Bud Gregory Blvd., Mississauga, Ontario, Canada, L4Z 2L3; Christopher W. A. Fredericks, 281 Sylvan Avenue, Scarborough, Ontario, Canada, M1E 1A7

[21] Appl. No.: 337,880

[22] Filed: Nov. 14, 1994

Related U.S. Application Data

[63] Continuation of Ser. No. 814,753, Dec. 30, 1991, abandoned.

[51] Int. Cl.[6] ..... A47K 3/22

[52] U.S. Cl. ..... 4/612; 4/900

[58] Field of Search ..... 4/596, 900, 612; 55/385.2

[56] References Cited

U.S. PATENT DOCUMENTS 4,796,311 1/1989 Shankman ..... 4/596

5,009,685 4/1991 Wilson et al. ..... 55/385.2

5,205,306 4/1993 Peterson ..... 4/615 X

*Primary Examiner*—Charles E. Phillips

[57] ABSTRACT

There is provided a mobile decontamination unit which includes a shower compartment. The shower compartment has a shower head and a drain located therein. There is a means for providing water to the shower head. There is a storage tank connected to the drain to store contaminated water from the shower compartment. There is a waiting compartment, that is preferably maintained under positive pressure, connected to the shower compartment. There is a means for maintaining the shower compartment at a negative air pressure. In another aspect of the invention, there is provided a mobile decontamination unit which includes a shower compartment. The shower compartment has a shower head and a drain located therein. There are means for providing water to the shower heads and means for heating the water before it reaches the shower heads. A storage tank is connected to the drains for storing contaminated water.

1 Claim, 2 Drawing Sheets

MOBILE DECONTAMINATION AND CONTAINMENT UNIT

This application is a continuation of prior, application Ser. No. 07/814,753 filed Dec. 30, 1991, now abandoned.

BACKGROUND OF THE INVENTION

This invention relates to methods of decontaminating persons using decontamination units and in particular a mobile decontamination unit which can be readily transported to an emergency site which involves hazardous materials.

With the wide spread use of hazardous chemicals, it is increasingly important to provide a mobile unit that can be readily transported to an emergency situation and can be easily used. Further, it may be necessary in the future to have a decontamination unit for any fire since many building materials contain toxic substances and accordingly it may be important for the fire and rescue personnel to go through a decontamination process before returning to their respective stations. It will be appreciated that the decontamination unit might also be used by police departments, ambulance services, hydro companies, gas companies, work departments, environmental agencies or transportation agencies since their personnel may also become exposed in emergency or even routine situations.

Some prior art references have recognized the need of decontaminating personnel. For instance, U.S. Pat. No. 4,796,311 issued Jan. 10, 1989 to Shankman shows an intake facility for use in conjunction with a hospital emergency room. The facility is to provide a system to decontaminate individuals prior to an individual mixing with the existing emergency room facilities. This intake facility includes a room for bagging the patient's clothing, a first shower room where the patient is sprayed with a mixture of water and detergent, a second shower room where the patient is sprayed with-Water, a drying room and a triage room.

Another device for decontaminating equipment and personnel is shown in U.S. Pat. No. 4,858,256 issued Aug. 22, 1989 to Shankman. This patent shows a mobile decontamination unit having a compartment for decontaminating personnel and a separate compartment for decontaminating equipment. The compartment for decontaminating personnel includes an area for the personnel to strip off their clothes and store them in bins, a shower area and a drying off area.

Taken alone or in combination none of these prior art patents show a decontamination unit which is mobile and which includes a plurality of compartments including first and second shower compartments having means for maintaining the shower compartments at a negative pressure so that the flow of contaminated air out of the shower compartments is reduced. Further, taken alone or in combination none of these prior art units show a decontamination unit which is mobile and which includes a plurality of shower compartments with changing portions and having means for heating the water so as to enhance the usability of the unit in the colder climates.

SUMMARY OF THE INVENTION

The subject invention provides a mobile decontamination unit having at least one shower compartment, a waiting compartment, and means for maintaining the one or more shower compartments at a negative air pressure.

In one aspect of the invention, there is provided a mobile decontamination unit which includes a shower compartment. The shower compartment has means for spraying water onto a user and a drain located therein. There are means for providing water to spraying means and a storage tank connected to the drain to store contaminated water from the shower compartment. There is a waiting compartment connected by a passageway to the shower compartment so as to permit the user to move from the shower compartment to the waiting room without leaving the unit. There are means for maintaining the shower compartment at a negative air pressure for reducing the amount of contaminated air that leaves the shower compartment.

According to another aspect of the invention, a mobile decontamination unit includes a plurality of interconnected shower compartments each having means for spraying water onto a user and a drain located therein, means for providing water to said spraying means, a storage tank connected to the drains, and means for maintaining the shower compartments at a negative air pressure for reducing the amount of contaminated air that leaves the shower compartments.

BRIEF DESCRIPTION OF THE DRAWINGS

A preferred embodiment of the invention will now be described by way of example only, with reference to the accompanying drawings, in which.

DETAILED DESCRIPTION OF THE PREFERRED EMBODIMENT

Figure 1:
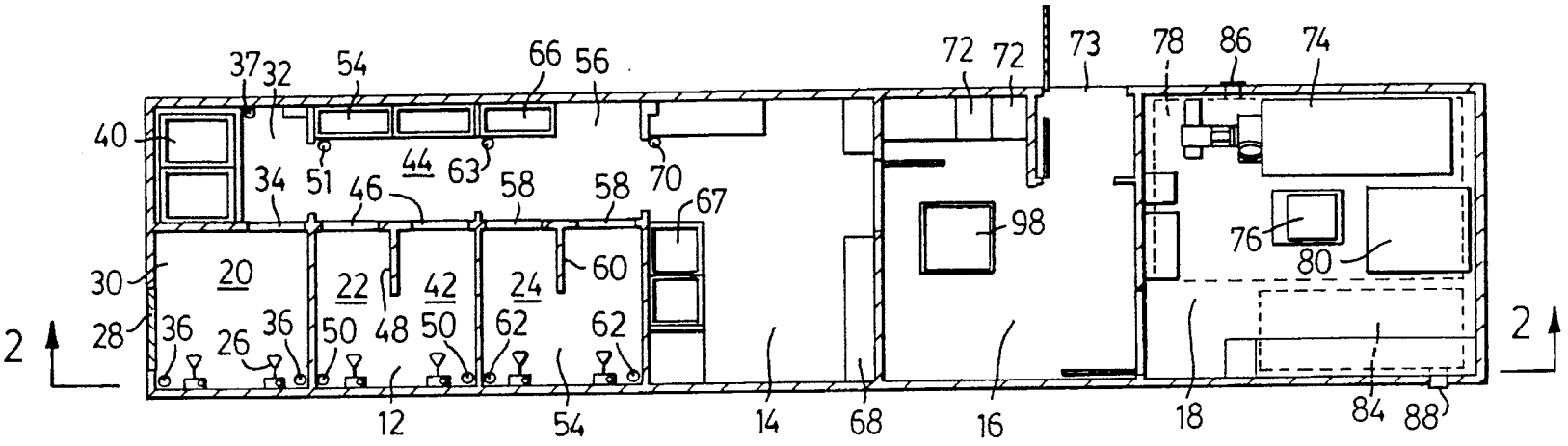
FIG. 1 is a plan view of the mobile decontamination unit.
Figure 2:
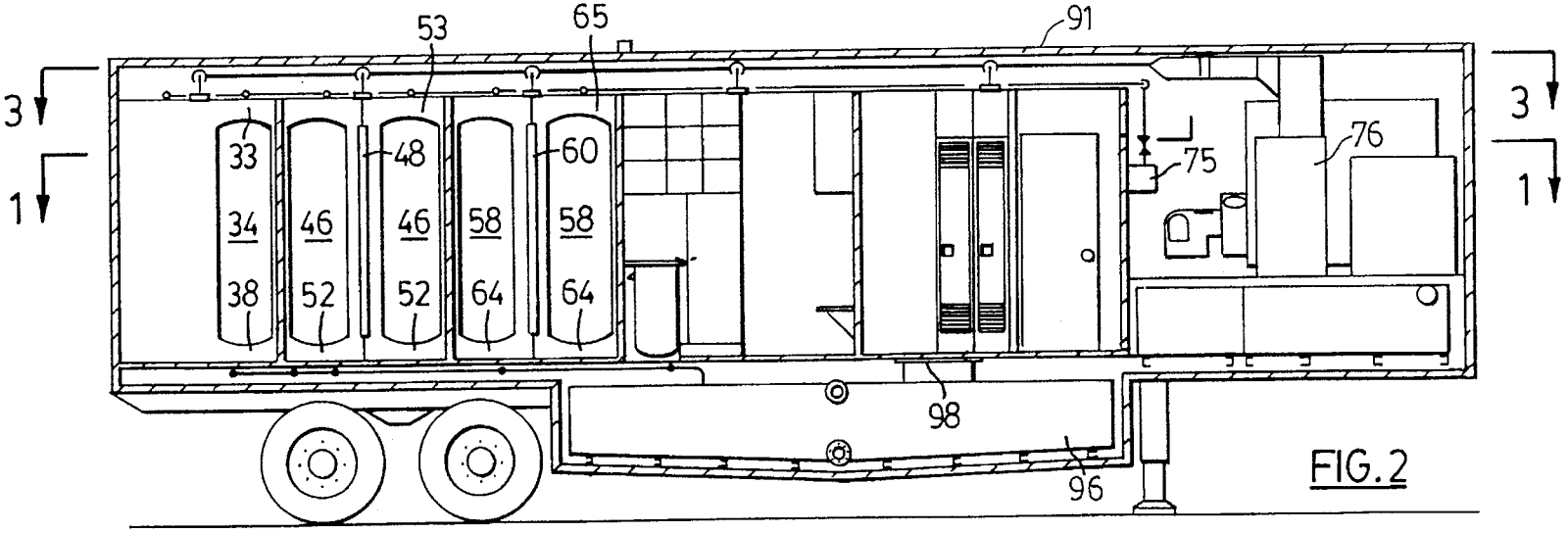
FIG. 2 is a sectional view of the mobile decontamination unit taken along line 2—2 of FIG. 1.

A preferred embodiment of the mobile decontamination unit of the subject invention will now be described with reference to FIGS. 1 through 3. Mobile decontamination unit 10 is divided into 4 areas namely, the shower area 12, a drying compartment 14, a waiting compartment 16 and a facilities compartment 18.

Shower area 12 includes three or more shower compartments 20, 22, 24. Shower compartment 20 has an entrance 28 at one end thereof and accordingly it is the first shower compartment that a contaminated individual would enter. The shower compartment is divided into a shower portion 30 and a changing portion 32 by doorway 34. The shower portion contains means for spraying water onto a user which can take the form of shower heads 26 of known construction or a number of spray nozzles. In a preferred version, the spraying devices provide overlapping sprays so as to provide thorough spraying resulting in maximum decontamination. Shower portion 30 has a floor which slopes downwardly towards a pair of drains 36. Changing portion 32 has a floor which slopes downwardly towards a drain 37. The doorway 34 has a raised lower portion 38, as can best be seen in FIG. 2, to prevent contaminated water from entering the changing portion 32. The doorway 34 may also have a dropped top 33 like a submarine bulkhead, if desired. The changing portion is provided with bins 40 and/or bags for storing contaminated outer clothing.

Shower compartment 22 is adjacent and interconnected to shower compartment 20 and is arranged in a similar fashion. It is divided into a shower portion 42 and a changing portion 44. One way of separating these portions is by a pair of doorways 46. Shower portion 42 may be divided into two sections by an optional wall 48. Shower portion 42 is provided with a pair of drains 50 and the floor slopes downwardly thereto. Changing portion 44 has a floor which slopes downwardly towards drain 51. Each doorway 46 has a raised lower portion 52 and a dropped or lowered top 53 (See FIG. 2). The changing portion 44 is provided with bins 54. If desired, a bulkhead-type doorway (not shown) can be provided between the changing portion 32 and the second changing portion 44.

Similarly, shower compartment 24 is adjacent and interconnected to shower compartment 22 and is arranged in a similar fashion. It is divided into a shower portion 54 and a changing portion 56 by a pair of doorways 58. Shower portion 54 may be divided into two sections by an optional wall 60. Shower portion 54 is provided with a pair of drains 62 and the floor slopes downwardly thereto. Changing portion 56 has a floor which slopes downwardly towards drain 63. Each doorway 58 has a raised lower portion 64 and a dropped or lowered top 65. The changing portion 56 is provided with a bin 66. In a preferred version, the showering nozzles in each of compartments 20, 22, and 24 provide overlapping sprays to obtain a maximum decontamination of the user of the facility. Again, if desired, a bulkhead-type doorway (not shown) can be provided between the changing portion 56 and the changing portion 44.

Drying off compartment 14 is adjacent and interconnected to shower compartment 24. It is provided with bins 67, a bin 69 for towels, and a seat 68. The floor of compartment 14 slopes downwardly towards drain 70 provided therein. An optional bulkhead-type door can be provided between the changing portion 56 and the drying off compartment 14.

Waiting compartment 16 is adjacent to drying off compartment 14. It is provided with lockers 72 and preferably shelves and seating. An exit 73 is provided in waiting compartment 16. The waiting room is preferably maintained at a positive pressure to help reduce the possibility of contamination in this room. The positive air pressure is maintained in the waiting compartment 16 by means of the air circulation fan of known construction that is part of a forced air heating system 76. It will be understood that the furnace or heater of the system 76 is only on when heating is required but the fan is on normally at all times to maintain the desired positive air pressure. Suitable known instrumentation to measure air pressure is provided in the unit to ensure that the desired air pressures are maintained. An optional ante room (not shown) can be provided between the drying off compartment 14 and the waiting room 16 and this ante room can also be maintained under positive pressure, again to help reduce the possibility of contamination in this area.

Facilities compartment 18 includes a diesel fired hot water heater 74, the aforementioned forced air heating system 76, a water storage tank 78, a diesel generating system 80, a circulating pump and pressure control 82 and diesel fuel tank 84. There are also means in the unit for tempering the water before it reaches the shower head. These would comprise a standard adjustment valve (also called a tempering valve) of known construction to adjust the mix of hot and cold water for each shower stall. In this way it is possible to provide a different water temperature in each shower. Inlet 86 is attached to storage tank 78 so that water can be pumped into the storage tank. Similarly an inlet 88 is attached to a diesel fuel tank 84 so that this may be filled. In one preferred embodiment, an air conditioning or air circulating system (not shown) is provided to cool this room 18 which otherwise might become quite warm because of the equipment therein. This system may comprise a ventilation system with a HEPA filter mounted in the intake.

Figure 3:
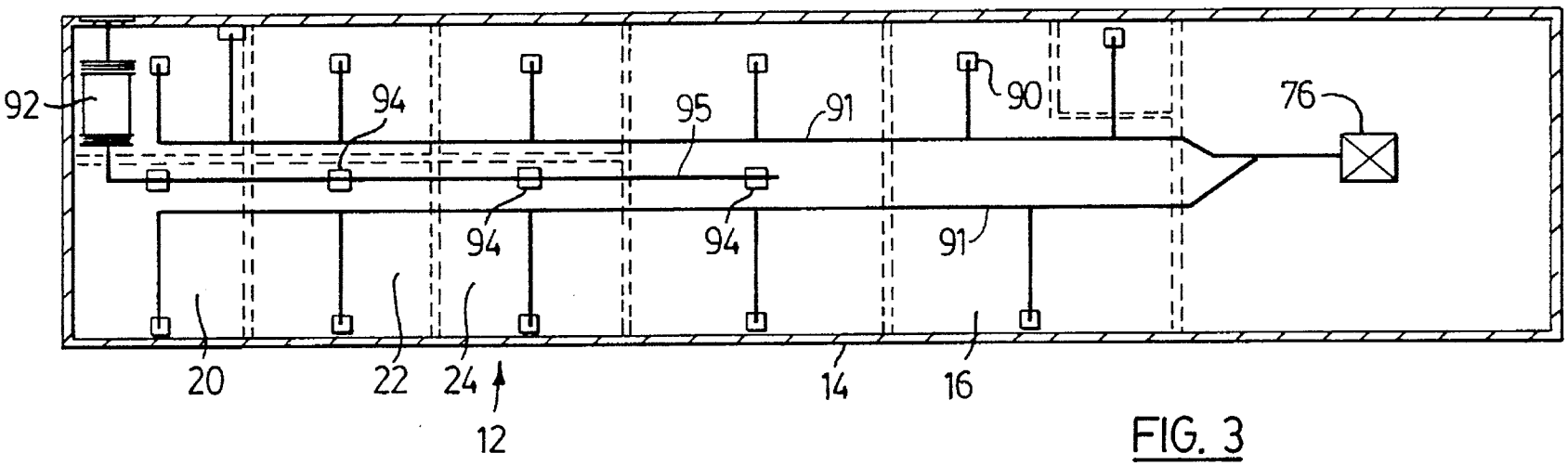
FIG. 3 is a plan view of the ceiling showing the distribution of the air through the mobile decontamination unit of FIG. 1.

The ventilation system and air circulation system is shown schematically in FIG. 3. Forced air heating system 76 is connected to each area 12, 14 and 16 respectively and each area has an air supply register 90. An exhaust fan 92 is attached to exhaust air registers 94 in shower compartments 20, 22 and 24 and dry-off compartment 14. Exhaust air is passed through an air washer or scrubber and a HEPA filter to clean the contaminated air before being released from the unit 10. Exhaust fan 92 and exhaust air registers are a means for maintaining shower areas 20, 22 and 24 and dry off compartment 14 at a negative pressure. It will be understood that the air is removed by this system at a faster rate than the air is supplied by the forced air furnace fan in order to achieve this negative pressure. Again, known pressure reading instrumentation can be provided to ensure the required negative pressures in these areas. By maintaining these compartments at a negative pressure, the contaminated air in these compartments will not mix freely with adjacent compartments.

Shower heads 26 are attached to the circulating pump and pressure control 82 and hot water heater 74 through conventional piping. Drains 36, 50, 62 are attached to storage tank 96. Storage tank 96 is provided with an inspection manhole 98. Instead of a single storage tank 96, there can be several such tanks, i.e. one for each shower compartment. The use of several tanks will reduce the amount of contamination present in the second, third or subsequent tanks.

In operation, the decontamination unit 10 would be brought to an emergency site. As fire and other emergency personnel become contaminated they would enter the decontamination unit 10 through entrance 28 and go through the showers in compartment 20 with their emergency gear on. They would strip their emergency gear and put that gear into bins 40 and then proceed into compartment 22. They would go through the showers in compartment 22 with their street clothes on and then remove their street clothes, put them into bins 54 and then proceed into compartment 24. They would then shower naked in compartment 24 and proceed into dry off compartment 14 where they would be provided with towels in bins 67. They would then proceed into waiting area 16 where they could dress in clothes stored in lockers 72 and then leave the decontamination unit through exit 73.

It will be appreciated by someone skilled in the art that a number of modifications could be made without departing from the spirit of the invention. For instance, for certain applications the number of shower stalls could be varied. In warm climates it may not be necessary to include the hot water heater. Further, the features of this unit could be on a trailer or installed in a truck. Further, other features may be added to the mobile decontamination unit such as a remotely activated shower valve to limit the time of each shower, or the provision of air under pressure for use by the personnel who are waiting to use the unit. Further compartments can be added to the decontamination unit if desired. For instance, the first shower compartment 20 can be expanded to provide an additional room or area for the removal of chemical suits. This additional room (not shown) can be a wet or dry area but it would be drained.

I claim:

1. A Mobile Decontamination Unit, a self contained mobile decontamination unit comprising of a mechanical system driven by an on board power source, operating a heating and ventilation system, an electrical system and a plumbing system, (with on board reservoir storage tank)

providing a means for directing water, heating, ventilation and lighting to the said mechanical room, waiting room and multiple showering compartment;

a first shower compartment comprising a first shower portion and adjacent changing portion, said shower having first means for spraying water onto a user prior to the said user removing any of his protective and outer clothing or equipment that may be contaminated, and a drain system located therein; said change portion to provide an area for removal of pre-showered outer and protective clothing and equipment; said changing portion to allow passage to second shower compartment and a drain system located therein;

a second shower comprising of a second shower portion and adjacent second changing portion, said second shower portion with second means for spraying water onto a user and a further drain system located therein; said second shower portion being completely separated from said first shower portion so that passage directly from the first to the second shower portion is not permitted without entering the changing portion;

means for providing water to said first and second spraying means;

storage tank means connected to the first and further drains;

means for maintaining the first and second shower compartments at a negative air pressure for reducing the amount of contaminant air that leaves the shower compartments; and a waiting room connected by a passageway to the second shower compartment so as to permit a user to move from said second shower compartment to said waiting room without leaving said unit, wherein the second shower compartment is connected by passageway to said changing portion so as to permit a user to move from said changing portion to said second shower compartment without returning to said first shower portion and without leaving said unit, means for keeping the waiting room at a positive pressure.

the option of a third shower compartment and adjacent change area with a drainage system therein; maintained at a negative pressure and connected by a passageway to the second shower compartment so as to permit a user to move from the second to the third shower compartment without leaving the unit.

* * * * *